US005295313A

United States Patent [19]

Lee

[11] Patent Number: 5,295,313

[45] Date of Patent: Mar. 22, 1994

[54] SELF-VENTILATING SHOE HAVING AN AIR-CONTROLLING DEVICE

[76] Inventor: Kuyn C. Lee, Taepyungyang Apt. 6-405, 1774-1 Daeyun 6-Dong, Nam-Ku, Pusan, Rep. of Korea

[21] Appl. No.: 992,698

[22] Filed: Dec. 18, 1992

[30] Foreign Application Priority Data

Dec. 19, 1991 [KR] Rep. of Korea ..... 9123379[U]

[51] Int. Cl.[5] ..... A43B 7/06; A43B 13/20

[52] U.S. Cl. ..... 36/3 R; 36/3 B; 36/28; 36/29; 36/88

[58] Field of Search ..... 36/3 A, 3 R, 3 B, 28, 36/29, 71, 88, 89, 35 B, 93, 153, 114

[56] References Cited

U.S. PATENT DOCUMENTS 4,361,969 12/1982 Vermonet ..... 36/29

4,860,463 8/1989 Pin ..... 36/3 R 4,991,317 2/1991 Lakic ..... 36/29

4,999,932 3/1991 Grim ..... 36/3 B

*Primary Examiner*—Paul T. Sewell

*Assistant Examiner*—M. D. Patterson

*Attorney, Agent, or Firm*—Birch, Stewart, Kolasch & Birch

[57] ABSTRACT

A self-ventilating device for a shoe, including an air-pumping member disposed in the heel portion of the insole thereof, an ankle-protecting air bag disposed in the heel portion of the insole thereof, an ankle-protecting air bag disposed in the interior of the upper thereof, and an automatic air-controlling member communicating with the air-pumping member and ankle-protecting air bag, whereby the shoe can be effectively ventilated and protect the ankle.

4 Claims, 2 Drawing Sheets

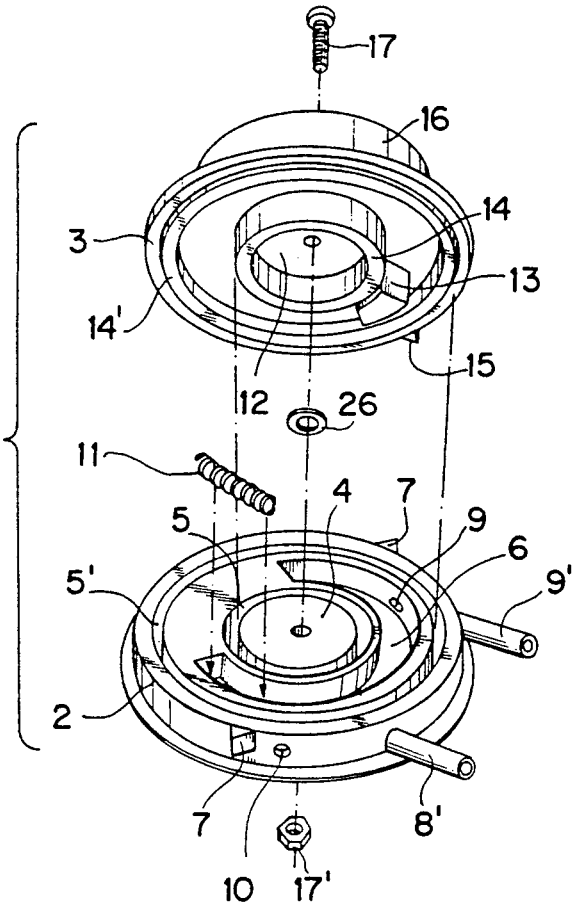
FIG. 1
FIG. 2
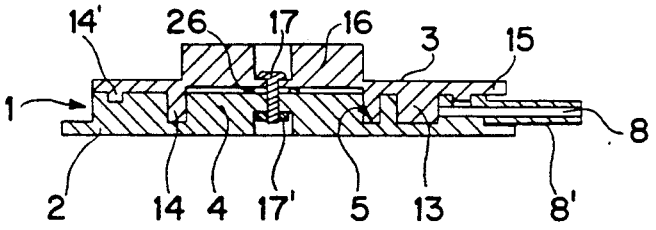
FIG. 3
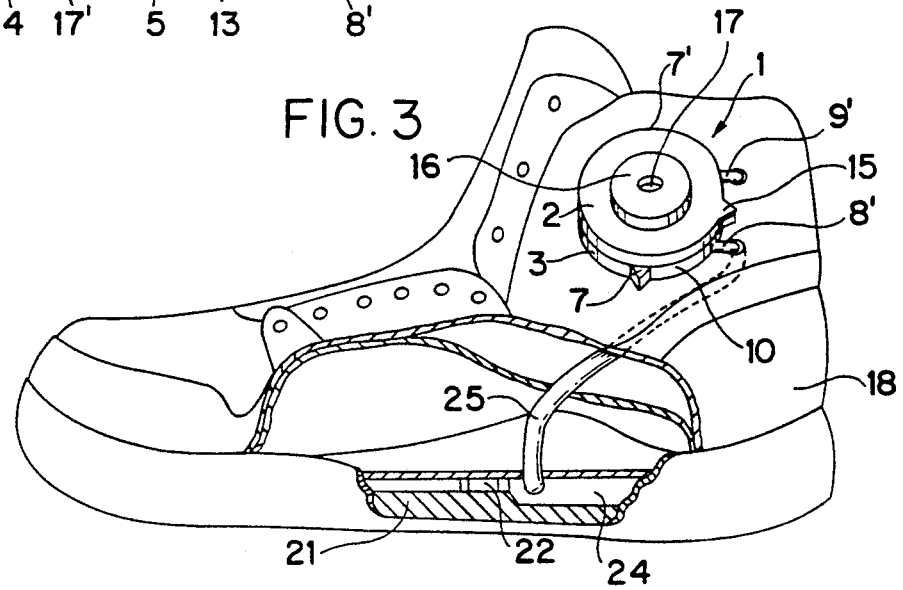

SELF-VENTILATING SHOE HAVING AN AIR-CONTROLLING DEVICE

BACKGROUND OF THE INVENTION

1. Field of the Invention

The present invention relates to a self-ventilating shoe and, more particularly, to a shoe having an air-pumping member, an ankle-protecting member, and an automatic air controlling member connected to both air-pumping and ankle-protecting members, whereby the shoe can be continuously ventilated and can automatically control air-suction and air-expulsion of the ankle-protecting member.

2. Description of the Related Art

Presently known ventilated shoes comprise elastomeric and resilient pads which are made of soft materials such as sponge or rubber and contain a plurality of holes in the sole and in the heel of the shoe in order to increase foot comfort. In these types of insoles, it is very difficult to remove moisture and the odor produced as a result of moisture which collects in the shoe due to foot sweating caused by poor shoe ventilation. Since most people use their shoes for long periods of time, it is essential to properly maintain and ventilate the shoes in order to avoid foot diseases, such as for example, water-eczema.

Various types of shoes having an ankle-protecting member are known in the art. However, the ankle-protecting member has an air bag which can be pumped full of air by a pump and in which air is expelled by hand so that it is difficult to use and damages the ankle due to a tight squeeze of the ankle-protecting member.

According to a report of the American Podiatry Association, 75 percent of the males and females stand or walk for 4 hours a day. Such foot stress leads to foot problems, particularly in males where athlete's foot fungi and the odor associated therewith have become a common problem.

In order to avoid such problems, Korean Utility Model Publication 90-9004 issued by the present inventor, discloses a ventilated military shoe which includes lower, middle, and inner soles for introducing air and a heel portion for discharging air, respectively. However, this shoe is difficult to construct, expensive to manufacture, and does not ventilate as effectively as the instant invention.

Also, U.S. Pat. No. 5,068,981 issued by the present inventor, discloses a shoe ventilation system which includes an upper portion having an air inlet and an air outlet disposed in the upper portion thereof, respectively, and a one-way air flowing member disposed in the lower portion thereof, an inner sole having a plurality of holes in the sole portion thereof and a plurality of channels and an arch extended portion disposed in the bottom surface thereof for communicating with the air flowing member, whereby the interior of the shoe can be continuously ventilated. However, this shoe is complicated in structure and cannot control air-suction and expulsion by itself.

SUMMARY OF THE INVENTION

Accordingly, it is an object of the present invention to provide a shoe ventilation system which is effective in providing a circulation of air within the shoe while it is in use.

Another object of the present invention is to provide a shoe which includes an air-pumping member disposed in a heel portion of the inner sole, an ankle-protecting member disposed in an upper portion of the inner upper of the shoe, and an automatic air-controlling member disposed in an upper portion of the outer upper of the shoe for communicating with the air-pumping and the automatic air-controlling members through soft pipes, whereby the shoe can be continuously ventilated and automatically controlled for air suction and air-discharge of an air bag of the air-protecting member.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention comprises a shoe ventilation system which includes an air-pumping member, an ankle-protecting member, and an automatic air-controlling member for continuously ventilating and communicating with the air-pumping member, ankle-protecting member and controlling suction and discharge of air in the air bag of the ankle-protecting member, whereby the shoes can be effectively ventilated and protect the ankle.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is an exploded perspective view of an automatic air-controlling device of the shoe according to the present invention;

FIG. 2 is a sectional view of the automatic air-controlling device according to the present invention;

FIG. 3 is a perspective view of the shoe containing cut-away portions in order to illustrate the construction of the shoe ventilation system according to the present invention;

PREFERRED EMBODIMENTS OF THE INVENTION

Figure 4:
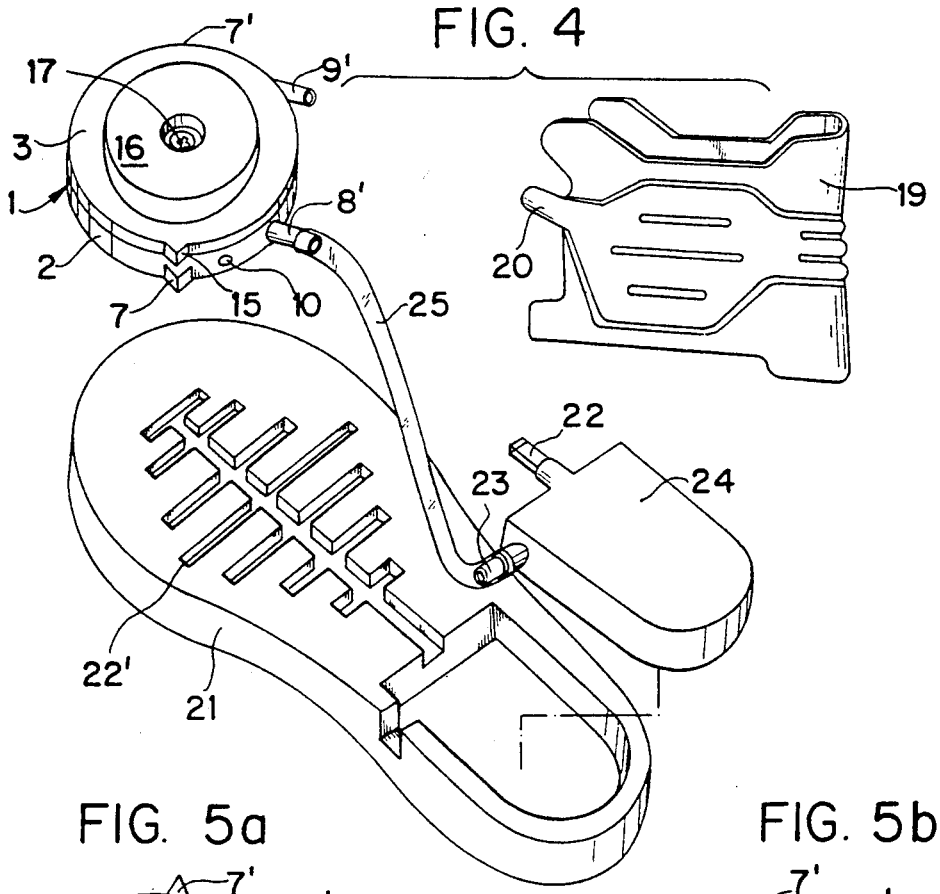
FIG. 4 is an exploded perspective view of the sole, air-controlling device, air-pumping device, and ankle-protecting device of the shoe according to the present invention.

Referring now in detail to the drawings for the purpose of illustrating preferred embodiments of the present invention, the self-ventilating shoe as shown in FIGS. 1, 2 and 4 comprises an automatic air-controlling member 1 disposed on the upper portion of the outer of an upper 18, an ankle-protecting air bag 19 built in an ankle portion of the interior of the upper 18 for communicating with the automatic air-controlling member 1 and an air-pumping member 24 disposed in the heel portion of an insole 21 thereof for discharging the air to the automatic air-controlling member 1 through a soft pipe 25. The soft pipe is made of a soft material such as, for example, plastic and rubber, etc.

As shown in FIG. 1, the automatic air-controlling member 1 includes a lower base member 2 having first and second grooved rings 5 and 5' and an upper cap member 3 having first and second raised rings 14 and 14' for assembling with the first and second grooved rings 5 and 5' of the lower base member 2, respectively, by a bolt 17, a washer 26 and a nut 17'. At this time, a circular raised center portion 4 of the lower base member 2 is inserted into a circular grooved center portion 12 of the upper cap member 3 and an air passage 6 disposed in the one side of the lower base member 2 still has a space for receiving a spring 11 when the upper cap member 3 is assembled with the lower base member 2. The air passage 6 occupies about one fourth of the lower base member 2. Since the first raised ring 14 extends into a handle 16, the first raised ring 14 and handle 16 are rotated about the bolt 17 at the same time.

The lower base member 2 further includes first and second dial indicating members 7 and 7' diametrically opposed to each other and disposed on the outer peripheral surface thereof (FIG. 4), an air outlet 10 and an air inlet/outlet 9 disposed on the wall of the air passage 6 and within both of the dial indicating members 7 and 7', and an air inlet pipe 8' and an air inlet/outlet pipe 9' communicating with the air inlet 8 and the air inlet/outlet 9', respectively (FIGS. 1 and 2).

The upper cap member 1 further includes the rotatable handle 16 disposed on the top thereof, an air controlling partition 13 disposed between both first and second raised rings 14 and 14', and a position indicating member 15 disposed on the outer surface thereof as shown in FIGS. 3 and 4.

As shown in FIGS. 3 and 4, the air bag 19 has an air inlet/outlet opening 20 connected to the air inlet/outlet pipe 9. Also, the air-pumping member 24 has a one-way air-discharging opening 23 connected to the air inlet pipe 8' through the soft pipe 25 and a waste air suction opening 22 connected to a plurality of discharging channels 22' disposed in the bottom surface of the insole 21 (FIG. 3).

Figure 5A:
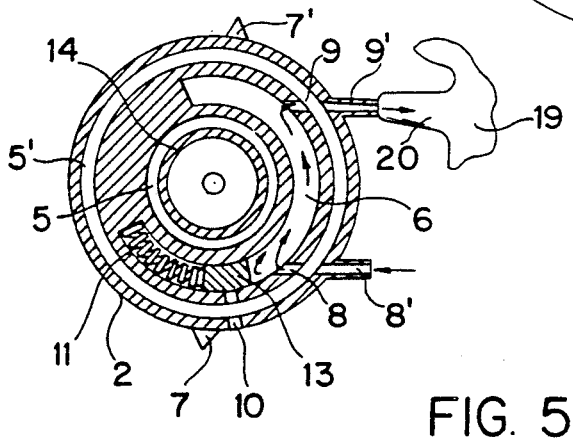
FIG. 5A is a cross-sectional view of the air-controlling device of the shoe according to the present invention showing a supply of air to the air bag of the ankle-protecting device.

The shoe ventilation system of the present invention operates as follows:

When the user wants to charge air into the ankle-protecting air bag 19 after the user wears shoes, the position indicating member 15 of the upper cap member 3 is adjusted to the first dial indicating member of the lower base member 2 by rotating the handle 16. At this time, the air outlet 10 is in the closed position as shown in FIG. 5A.

Thereafter, as the wearer of the shoes places the heel thereof against the ground in taking a step, the insole 21 is compressed and the air in the air-pumping member 24 is discharged into the ankle-protecting air bag 19 through the one-way air-discharging opening 23, the soft pipe 25, the air inlet pipe 8', the air inlet 8, the air passage 6, the inlet/outlet 9, and the air inlet/outlet pipe 9'. At this time, the one-way waste air suction opening 22 is in the closed position.

Accordingly, when the wearer of the shoes removes the heel thereof from the ground, the waste air suction opening 22 is in the open position and the waste air in the shoes is discharged into the air-pumping member 24. In turn, when the wearer places the heel thereof against the ground, the collected air in the air-pumping member 24 is discharged into the ankle-protecting air bag 19. Thus, the operation is repeated until the air bag 19 is filled with air.

Figure 5B:
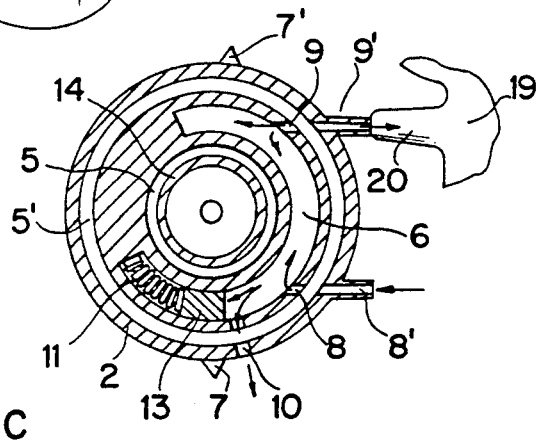
FIG. 5B is a cross-sectional view of the air-controlling device of the shoe according to the present invention showing discharging of air from the air bag after the air bag is filled with air.

After the air bag 19 is filled with air, the pressure of the air in the air passage 6 pushes the air controlling partition 13 and the spring 11 is compressed so that the air outlet 10 is in the open position as shown in FIG. 5B. Therefore, the excess waste air is automatically discharged to the atmosphere. Thus, as shown in FIGS. 5A and 5B, the air suction, air fullness, and air discharge proceed in sequence.

Figure 5C:
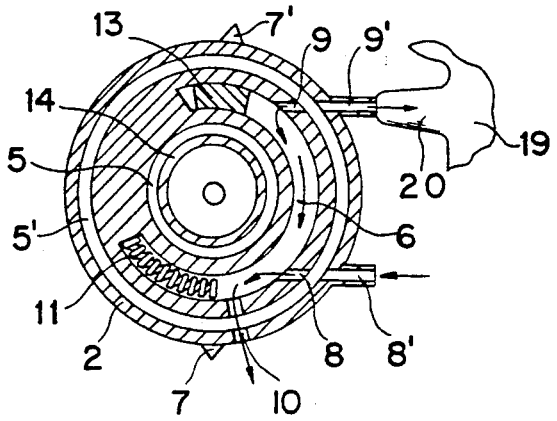
FIG. 5C is a cross-sectional view of the air-controlling device of the shoe according to the present invention showing discharging of air from the air bag and simultaneously discharging air from the shoe.

However, when the wearer wants to remove the shoes, as shown in FIG. 5C, the position indicating member 15 of the upper cap member 3 is adjusted to the second dial indicating member 7' of the lower base member 2 by rotating the handle 16. At this time, the air controlling partition 13 is moved from the air outlet 10 and the air passage 6 is opened, and the air in the ankle-protecting air bag 19 is discharged to the atmosphere.

From the start, in order to use the shoes according to the present invention as an air discharge function, the position indicating member 15 of the upper cap member 3 is adjusted to the second dial indicating member 7' of the lower base member 2 by rotating the handle 16 so that the air outlet 10 is the open position, and the waste air is continuously discharged to the atmosphere through the soft pipe 25, the air passage 6, and the air outlet 10.

Thus, the flow of fresh air into the interior of the shoe with every step taken by the wearer functions to keep the foot dry and cool, thereby inhibiting the formation of foot fungi and other foot diseases, the insole 21 also provides a cushioning effect to the wearer which reduces the amount of body shock produced by walking. Also, the shoe can protect the ankle by using the ankle-protecting member 19.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilation system for a shoe, which comprises:

an insole provided in said shoe, said insole including a toe portion and a heel portion;

an upper formed above said insole of said shoe;

an air-pumping member disposed in the heel portion of the insole of said shoe, said air-pumping member including a one-way air discharging opening and a one-way air suction opening connected to a plurality of air-discharging channels disposed in the toe portion of said insole;

an ankle-protecting air bag built in an ankle portion of the upper of said shoe, said ankle-protecting air bag including an air inlet/outlet opening; and an automatic air-controlling member disposed on an outer and upper portion of the upper, said automatic air-controlling member including:

a lower base member having an air passage disposed therein, a spring housed in the air passage, first and second dial indicating members disposed on an outer periphery of said lower base member, an air inlet and an air inlet/outlet disposed in a peripheral wall of said air passage and between said first and second dial indicating members with the inlet connecting to said one-way air discharging opening of the air-pumping member and the air inlet/outlet connecting to said air inlet/outlet opening of said ankle-protecting air bag, respectively, and an air outlet disposed on the peripheral wall of said air passage and between said first dial indicating member and said air inlet opening, an upper cap member rotatably assembled with said lower base member, an air controlling partition attached to a first raised ring extending from said upper cap member, and a position indicating member disposed on an outer periphery of said upper cap, whereby upon adjusting the position indicating member to the first dial indicating member and applying pressure to the insole, air is discharged into the ankle-protecting member through the air passage and when the ankle-protecting air bag is filled with air, the one-way air outlet is opened and the air is expelled to the atmosphere, and absent the use of the ankle-protecting air bag, upon adjusting the position indicating member to the second dial indicating member, when pressure is applied to the insole, air is discharged to the atmosphere through the air passage and the air outlet and the air in the ankle-protecting air bag is also expelled to the atmosphere when the shoe is removed.

2. The ventilation system of claim 1, wherein said automatic air-controlling member is provided with a soft pipe made of a soft material for connecting said air-pumping member to said ankle-protecting air bag.

3. The ventilation system of claim 1, wherein said lower base member includes first and second grooved rings and said upper cap member includes first and second raised rings for movably fitting within said grooved rings such that during assembly, said handle and said first raised ring are simultaneously rotated since the handle is coextensive with the first raised ring.

4. The ventilation system of claim 3, further including a bolt for rotatably securing said upper cap member to said lower base member, wherein said bolt is associated with a nut and a washer.

* * * * *